United States Patent [19]

Stuart

[11] Patent Number: 5,060,895

[45] Date of Patent: Oct. 29, 1991

[54] PAINT ROLLER HOLDER MOUNTABLE IN SINK DRAIN

[76] Inventor: David P. Stuart, 120 Westchester Ter., Annadale, N.J. 08801

[21] Appl. No.: 535,551

[22] Filed: Jun. 11, 1990

[51] Int. Cl.[5] ..... B08B 3/02

[52] U.S. Cl. ..... 248/176; 248/229; 248/231.8; 248/316.7; 134/900

[58] Field of Search ..... 248/176, 229, 316.7, 248/231.8, 231.3, 316.7; 211/60.1, 70.6; 4/286, 628, 656, 654, 292, 289; 134/900

[56] References Cited

U.S. PATENT DOCUMENTS

| | | | |
|---|---|---|---|
| 978,913 | 12/1910 | Madden | 4/286 X |
| 2,433,423 | 12/1947 | Broadman | 4/292 |
| 3,421,527 | 1/1969 | Dettman | 134/138 |
| 3,428,060 | 2/1969 | Spivey | 134/138 X |
| 4,044,409 | 8/1977 | Hood | 4/286 X |
| 4,093,389 | 6/1978 | Wibrow | 403/297 X |
| 4,205,710 | 6/1980 | Dunicz | 4/286 X |
| 4,422,790 | 12/1983 | Gebert et al. | 403/297 X |
| 4,484,407 | 11/1984 | Petersson | 403/297 X |
| 4,708,152 | 11/1987 | Hibberd | 134/138 |
| 4,751,752 | 6/1988 | Ewing | 4/292 X |

FOREIGN PATENT DOCUMENTS

| | | | |
|---|---|---|---|
| 525171 | 5/1931 | Fed. Rep. of Germany | 4/292 |

*Primary Examiner*—Alvin C. Chin-Shue

*Attorney, Agent, or Firm*—William T. Hough

[57] ABSTRACT

In a preferred embodiment, a sink drain paint roller holder having a base structure mountable within a sink drain, and mounted on an upper portion of the base structure there being upright elongated support structures around which a paint roller of any of variable sizes fits, the elongated support structures including a plurality of upwardly-extending yieldable and/or flexible elongated members having radially-inwardly directed upper distal ends and lower proximal ends relative to the mid-portions thereof and relative to an imaginary longitudinal axis of the upwardly extending support structures, and the base including a plurality of downwardly flexible elongated members having radially-inwardly directed lower distal ends and upper proximal ends relative to the mid-portions thereof and relative to the imaginary longitudinal axis of the upwardly extending support structures, the base structure and the upwardly extending support structures jointly forming a drain flow path into a sink drain for liquid draining from a paint roller when mounted on the upwardly extending support structures and when the paint roller holder is mounted within a sink drain.

10 Claims, 4 Drawing Sheets

PAINT ROLLER HOLDER MOUNTABLE IN SINK DRAIN

This invention is directed to a sink drain paint roller holder utilizable for washing a paint roller.

PRIOR ART

While a preliminary patentability search failed to locate any relevant patent, finding nothing relating to the upright support or washing of paint rollers within a sink drain, art of mere interest includes the U.S. Pat. No. 3,377,634 (issued Apr. 16, 1968) directed to a sink drain mountable drain basket (vessel) for draining rinse water from rinsed eating utensiles piled therein such as spoons and knives. Likewise, U.S. Pat. No. 3,333,238 (issued Aug. 1, 1967) is directed to a sink drain mountable vessel.

BACKGROUND TO THE INVENTION

Prior to the present invention, there have existed problems in holding or otherwise supporting paint rollers when washing paint therefrom and draining the same after use of the roller, as well as avoiding repeated soiling of a person or his clothing and in avoiding the soiling of the roller after the washing thereof prior to its drying. Also, proper draining during and after washing the roller has not heretofore been adequately possible. The absence of solutions to above-noted problems has resulted in inadequate washing and in resulting deterioration of destruction of the paint rollers with regard to potential future repeated use thereof subsequently. With regard to the present invention of providing a support therefor within a sink drain, additional were encountered with regard to insuring essential drainage for paint being washed from the roller, as well as prevention of blocking of normal drainage from the sink itself.

THE OBJECTS

Accordingly, objects of the invention include the overcoming and/or avoiding of problems and/or difficulties and/or inconveniences of the type discussed above.

More particularly, an object of the invention is to provide a drain mountable paint-roller support for the washing and draining of specifically and particularly paint roller(s) after painting use thereof.

Another object is to provide for proper and essential drainage of liquid such as water, paint and/or combinations thereof being or to be washed from a paint roller being mounted in a sink drain by the inventive holder of this invention.

Another object is to provide for proper and essential continued drainage of liquid such as water or the like from the sink from areas surrounding the inventive holder when the holder is mounted within the sink drain.

Another object is to obtain a paint roller holder of this invention that is mountable of any of paint rollers of diverse inner diameter dimensions.

Another object is to obtain a paint roller holder of this invention that is firmly mountable of a paint roller thereon, devoid of shifting.

Another, object is to obtain a paint roller holder of this invention mountable within a conventional sink drain in a non-shifting and sturdy manner.

Another object is to obtain a paint roller holder that is simply and easily mountable within a sink drain devoid of need to resort to screw drivers or other complicated mechanisms of mounting.

Another object is to obtain a paint roller holder susceptable for easy mounting in any of sink drains of diverse inner diameters.

Another object is to obtain a paint roller holder having a high degree of sturdiness and/or durability.

Another object is to obtain a paint roller holder combination inclusive of a drain vessel seatable of the paint roller holder after washing, during continued draining and drying thereof and/or during storage.

Other objects become apparent from the preceding and following disclosure.

Objects of the invention are obtained by the invention disclosed herein.

BROAD DESCRIPTION

Broadly the invention may be described as a sink drain paint roller holder for roller washing and draining. Broadly as a combination the invention includes a base structure and mechanism thereof and mounted on an upper portion thereof, uprightly upwardly extending paint-roller support structure and mechanism thereof. The base structure is shaped and adapted for the fitting thereof and secure mounting thereof into a sink drain typically from which the strainer-structure has been lifted (removed). The base structure has continuous upper and lower base structures forming a drain flow-path from above to below the base structure. The uprightly upwardly extending paint-roller support structure is shaped and adapted for the upright supporting of a tubular end of a hollow paint roller having a longitudinal axis such that the longitudinal axis extends upwardly and downwardly when the hollow paint roller is upwardly mounted on the uprightly upwardly extending paint roller support structure. The uprightly upwardly extending paint-roller support structure is mounted on the base means and is positioned and structured such that drainage from the hollow paint roller is drainable through the drain flow-path into the sink drain.

Preferably and critically the upright upwardly extending paint-roller support structure extends upwardly along an imaginary support longitudinal axis and has spaced-apart outer paint-roller support surfaces ranging radially outwardly around the imaginary support longitudinal axis to an outer diameter ranging up to about an inner diameter of the hollow paint roller mountable on the upwardly-extending paint-roller support means. This is critical because of the total inability to preferably adequately and/or methodically wash a paint roller loosely held in a flimsy and shifting state on a support member that would fail to firmly engage an inner surface of a supported paint roller.

Also preferably and critically the upwardly-extending paint-roller support structure includes radially outwardly positioned inner surfaces spaced-apart from one-another around the above-noted imaginary support longitudinal axis. The radially outwardly positioned inner surfaces form an inner drain space therebetween in flow communication with the above-noted drain flow path. In order to achieve more optimal and effective drainage from a paint-laden paint roller mounted thereon, it is required that there be this inner drain space formed as above-noted such that drain space becomes a part of the above-noted drain flow path.

In another preferred and critical embodiment, the lower base structure is required to have lower spaced-apart walls forming the above-noted drain flow path therebetween, and in conjunction therewith the upper base structure is required to have at-least one through-space forming-structure forming first through-space between said lower spaced-apart walls in communication with said drain flow path. Thereby, there is provided the essential drainage from space above the upper base structure to the flow path between the lower spaced-apart wall, to obtain this preferred result.

In this preferred and critical embodiment, in like manner and/or structure as in the preceding paragraph's preferred and critical embodiment, the lower base structure has the lower spaced-apart walls forming the drain flow path therebetween, but the upper base structure has a plurality of first through-space forming-structure forming first through-space in communication with said drain flow path; it is implicit that minimal preferred results would be obtain if solely one of the through-space existed, as contrasted to this preferred plurality thereof. Criticality for this preferred results rests on the same basis as above-noted, the plurality being moreover additionally necessary for a practical preferred degree of improved results for the present invention.

For an additional preferred and critical embodiment, the first through-space forming-structure and the first through-space thereof are positioned at-least in-part radially outwardly of said spaced-apart outer paint-roller support surfaces. This is because a substantial and major amount of paint and rinsing water, when washing a paint-laden paint roller, will drain directly downwardly, rather than passing through apertures into an inner drain space.

For a further preferred and critical embodiment, for reasons akin to those noted in the preceding paragraph, the uprightly upwardly extending paint-roller support structure and mechanism thereof, includes second through space-forming structure forming second through-space(s) between the inner and outer surfaces—permitting draining paint and water to pass into the inner-located flow and drain space, in flow communication with the above-noted first through-space. It is essential that to enhance the easy drainage of such wash or rinsing water and paint being washed from the roller, that significant drainage pass from the outer surface to the inner surface of the roller support(s) into the inner drain space.

For another preferred and critical embodiment, the uprightly upwardly-extending paint-roller support means includes separate upwardly-extending elongated members each having a lower proximal end mounted on the base means and having an upper distal end directed upwardly and having an intermediate portions between the upper distal ends and the lower proximal ends. The preferred and critical structure here defined effectively result in a maximum of flow space both outside of and inside of the plurality of upwardly-elongated members, achieving significantly improved results in the use thereof during the washing of paint from a mounted paint roller.

In another further preferred and critical embodiment of the above-noted preferred embodiment described in the preceding paragraph, at-least one of the elongated members is resilient such that said upwardly extending paint-roller support structure end mechanism thereof, engages and supports and fits within an annular space of any of paint rollers of diverse diameters. From time to time and/or for different manufacturers, paint rollers of differing inside diameters sometimes come into being. Additionally, for any tubular paint roller the presence of at-least one radially outwardly pressing resilient one of the elongated members results in significantly improved and firm holding of the mounted paint roller, and ultimately in improved washing and draining thereof.

In a further preferred and critical embodiment of the above-noted preferred embodiment of the preceding paragraph, significant further improved results are obtainable for the same reasons when as in this embodiment the elongated members each and all are resilient such that said upwardly extending paint-roller support means engages and supports and fits within an annular space of any of paint rollers of diverse diameters.

In a further preferred and critical embodiment of the above-noted preferred embodiment of the preceding paragraph, significant further improved results are obtainable where as in this embodiment the distal ends of the elongated members are more closely spaced to one-another and to the imaginary support longitudinal axis than a lower portions of the elongated members. With this arrangement, there is provided significantly greater ease and accuracy in the mounting of a tubular end of a paint roller downwardly around the thereby bunched-together distal ends whereby the mounting onto the elongated members is significantly facilitated, particularly for persons having typically average or below average mechanical skills.

For another preferred and critical embodiment, the above-noted upper base structure includes laterally extending structure having radially outwardly positioned support structure, and from the laterally extending structure there are downwardly-extending spaced-apart flange structures forming consecutively-occuring spaced-apart flanges. The downwardly-extending spaced-apart flange structures are separated by through-space gaps between the consecutively-occuring downwardly-extending flanges. The downwardly-extending spaced-apart flanges are seatable on a sink bottom, thereby supporting the radially outwardly positioned support structure above the sink bottom such said gaps are in flow communication with the sink drain. Thus, thereby flowable liquid in a sink is drainable through the gaps into a drain within which the paint roller sink-holder is mounted. Such gaps are essential for the significantly improved sink drainage during use of the paint roller mount of this invention.

In another preferred and critical embodiment, there is an upwardly extending flange mounted on the radially outwardly positioned support structure circumscribing. The upwardly extending flange is spaced-from the above-noted outer surfaces and circumscribe the outer surfaces. Thereby, drainable liquid drainable onto the radially outwardly positioned support structure is retained from draining into the sink prior to its draining into the flow path into the sink drain.

In another preferred and critical embodiment, the above-noted lower spaced-apart walls include separate downwardly-extending elongated members each having a lower proximal end mounted on said upper base structure and having a lower distal end directed downwardly. As a result of this arrangement, this structure provides a maximum of lower flow and drainage space within the sink drain in which the downwardly-extending elongated members are normally mounted, such structure being essential to obtain the significantly improved devoid of possibilities of retarded or blocked drainage from or by draining paint being washed from a mounted paint roller.

In a further preferred and critical arrangement or embodiment of the preferred embodiment set-forth in the preceding paragraph, at-least one of the downwardly-extending elongated members is resilient. As a result thereof, the lower base structure resiliently engages and securely and stably fits within any sink drain of any diameter to a significantly greater degree than if devoid of such resilient downwardly-extending elongated member.

In a still further improved preferred and critical embodiment of the preferred embodiment set-forth in the preceding paragraph, the downwardly extending elongated members each are resilient such that the lower base structure resiliently engages and fits within any sink drain of any diameter.

In a further preferred and critical embodiment of the preferred embodiment of the preceding paragraph, each of the downwardly-extending elongated members includes a lower proximal end mounted on the upper base structure and a lower distal end directed downwardly, and a lower intermediate portion downwardly-extending.

In a further preferred and critical embodiment, the lower distal ends at radially outer surfaces thereof are more distantly spaced from one-another relative to the lower intermediate portions at outer surfaces thereof and relative to the imaginary support longitudinal axis, and less distantly spaced-apart relative to the lower proximal ends. Thereby the lower proximal ends are resiliently pressed against side sink drain wall of any of sink drains of different inner diameters.

In another preferred and critical embodiment, outer surfaces of the lower proximal ends are more distantly spaced from one another relative to the lower intermediate portions and relative to the imaginary support longitudinal axis, and the diametric distance between an imaginary line circumscribing the outer surfaces of the lower proximal ends is greater than a predetermined sink drain inner diameter. I hereby, the lower proximate ends rest on the edge of the sink at the sink drain supporting the lower proximate ends above the top of the sink drain whereby additional drainage space is provided for drainage of liquid from the sink into the sink drain.

The invention may be better understood by making reference to the drawings of the following Figures.

THE FIGURES

FIG. 1 diagrammatically illustrates a side view of a preferred embodiment with partial cut-aways for improved illustration.

FIG. 2 diagrammatically illustrates a top view of the embodiment of FIG. 1.

FIG. 3 diagrammatically illustrates in side view a greater preferred combination, inclusive of a sink bottom seatable open top vessel above described, mounted therein typically the embodiment of FIGS. 1 and 2.

FIG. 4 diagrammatically illustrates in view another preferred embodiment.

FIG. 5 diagrammatically illustrates a top view of the embodiment of FIG. 4.

FIG. 6 diagrammatically illustrates in side view with partial cut-away for improved illustration, another preferred embodiment.

FIG. 7 illustrates a top view of the embodiment of FIG. 6.

FIG. 8 diagrammatically illustrates a side view with partial cut-away for improved illustration, another preferred embodiment.

FIG. 9 illustrates a top view of the preferred embodiment of FIG. 8.

DETAILED DESCRIPTION

In the following description of the above-illustrated embodiments, for identical elements of the same embodiment in different Figures, the same indicia are utilized. For elements of corresponding functions of different embodiments, different but related indicia are utilized. Once an element or related element has been described for one embodiment, description is not repeated for other embodiments, except in some instances to improve understanding.

For the various embodiments of the present invention, the matter or material or composition from which the elements thereof is/are made is not significant to the present invention, except to the extent that reasonable firmness or rigidity is required in most instances, and except that resilient and/or flexible material is required where such flexible characteristic is called for in certain instances as set-forth in the disclosure. Accordingly, all or some of the elements thereof may be of appropriate or desired metal such brass, aluminum, stainless steel, or the like, and/or plastic(s) such as nylon, polypropyl-ene or the like, and/or fiber glass, for example.

FIG. 1 illustrates a sink drain paint roller holder 10 having upper base structure typically inclusive of the upper tubular wall 14*a* having inner surface (face) 14*b* and the radially or laterally outwardly extending support structure 32 having the upwardly extending circumscribing flange 12*a* having inside liquid-retaining surface 12*b* forming typically upper opening space 13*b* at the top end 13*a* of the upright flange (wall) 12*a*, and lower base structure typically inclusive of the lower tubular wall 14*a*. Also illustrated is the uprightly upwardly extending paint-roller support structure 11*a* in tubular form with inner wall surface 11*b* having tubular inner drain space 34 having lower end-wall 11*d* forming lower opening 11*d'* and having upper opening 11*c'* at the upper tubular end 11*c*, with through-space apertures 15*a*, 15*a'*, 15''*a*, 15'''*a* and the like. The lower base tubular wall 14*aa* has semicircular cutout/through-spaces 18*a*, 18*a'* and 18*a''* for example, at the bottom end, providing additional liquid communication and flow space in the event that the bottom is resting on a sink drain bottom surface. There is communication drain-passage 15*a'''* passing through both inner wall surface 11*b* of wall 11*a* and the upper tubular wall 14*a*. The upper base portion also includes the downwardly-directed through-space 16 in the laterally outwardly-extending support structure 32, and the laterally-extending through-space 17*a''* and 17*a* and 17*a'* for example. The bottom face 12*c* of laterally outwardly-extending support structure 32 has the downwardly-extending spaced-apart flanges 30 adapted for resting on the sink bottom to thereby permit sink water to pass toward and into the sink drain while the lower base structure 14*aa* is mounted within the sink drain. There are support flanges such as 20*b* extending between the upper base structure 14*a* and the upright flange (wall) 12*a*. The lower tubular end 11*d* forms lower-end opening/-flow space opening 11*d* as a communication with the drainable flow-path, for liquid to flow into lower base tubular space 33 circumscribed by its inner wall surface 14*bb;* the upper inner wall surface 14*bb'* seats the lower tubular wall 11*b*'. The outer wall surface 11*d*" seats against the radially inward edge of horizontally positioned radially outwardly-extending support structure 32 forming an annulus hole 31 within which the wall 11*a* is mounted at its lower end; it is noted that annulus hole or space 31 is a continuation with the space 33, and of space 34, the flow space 33 communicating with the space 34, as a part of general flow space. Gaps 17'*a* between flanges 30 permit the water or other liquid in the sink to pass to the sink drain. At the top of the upwardly-extending flange 12*a* is located the laterally extending flange structure shown as 19*a* and 19*a*'. Also shown is imaginary axis x.

FIG. 2 illustrates a top view with partial cut-away, of the embodiment of FIG. 1, thus also disclosing the preferred embodiment of the sink drain paint roller holder 10. In addition to elements already identified above, there are additionally shown in this view, optional inner support bars 23*a* and 23*b*, as well as also showing other support flanges 20*a*, 20*c* and 20*d*.

FIG. 3 illustrates with partial cut-away, the preferred embodiment of FIGS. 1 and 2 mounted (seated) in an open top vessel having side walls 21*a* having inner wall face 21*b* and bottom 22 and open-top 21*a*' to inner space 21", sitting on imaginary surface 25. The walls 21 at their upper-most locations 23 engage and fit beneath and support the laterally extending flange structure 19*a*. As seated in the vessel, the upwardly-extending flanges (walls) 12*a* fit against the above-noted vessel inner surface 21*b*. Symbolically in broken imaginary lines 28*a*, there is shown a representative paint roller in its mounted state and position. All other elements have been previously described above.

FIG. 4 illustrates the preferred embodiment of FIG. 4 in the side view thereof, of the sink drain paint roller holder 10*a*. In this embodiment, the uprightly upwardly extending paint-roller support structure and mechanism thereof, includes the separate upwardly-extending elongated members cumulatively designated 25, having upper distal ends 26*a*, 26*b*, 26*c* and 26*d* (not viewable) and upper proximal ends 25*a*', 25*b*', 25*c*', and 25*d*" (not viewable), and upper intermediate portions 25*a*, 25*b*, 25*c* and 25*d* (not viewable), all extending upwardly from and integral with the annular upper base structure 14*a*', extending from spaced-apart points along inner circumscribing portion (shown in FIG. 5) of the annular upper base structure. The separate upwardly-extending elongated members 25 are resilient or flexible or spring-like members biased outwardly sufficiently for the intermediate portions to press outwardly against inner wall surfaces of a mounted paint roller when mounted thereon, by virtue of the upper distal ends and the upper proximal ends being spaced-apart less than (i.e. closer together than) the intermediate portions. Extending downwardly from the annular upper base structure 14*a*' from the upper base structure points (locations) 24*a*, 24*b* and 24*c* (shown in FIG. 5) is the lower base structure which in this preferred embodiment includes the separate downwardly-extending elongated members cumulatively designated 29, having lower proximal ends 28*a*, 28*b* and 28*c* mounted on and integral with the circumscribing outer edge of the above-noted annular upper base structure 14*a*' at spaced-apart intervals, spaced apart from one-another relative to the previously noted imaginary axis x'. The downwardly-extending elongated members have the illustrated lower distal ends 29*a*, 29*b* and 29*c*, and lower intermediate portions 29*a*', 29*b*' and 29*c*'. It will be observed that at points (locations) between the lower proximal ends and the lower intermediate portions, the downwardly-extending members when mounted within a sink drain rest on the edge 35 (shown in imaginary phantom lines) such that the sink drain paint roller holder is thereby supported above a sink bottom of which it is mounted in the drain thereof. As mounted within a sink drain, the lower distal ends press supportingly against upright sides of the sink drain, as a result of the lower intermediate portions being more distantly spaced to one-another relative to the lower intermediate portions and relative to the imaginary support longitudinal axis x'. In this particular preferred embodiment, the downwardly-extending members 29 each and all are resilient or flexible or spring-like, such that the lower distal ends all resiliently exert supporting pressure against the sides of the drain when pressed thereinto.

Figure 1:
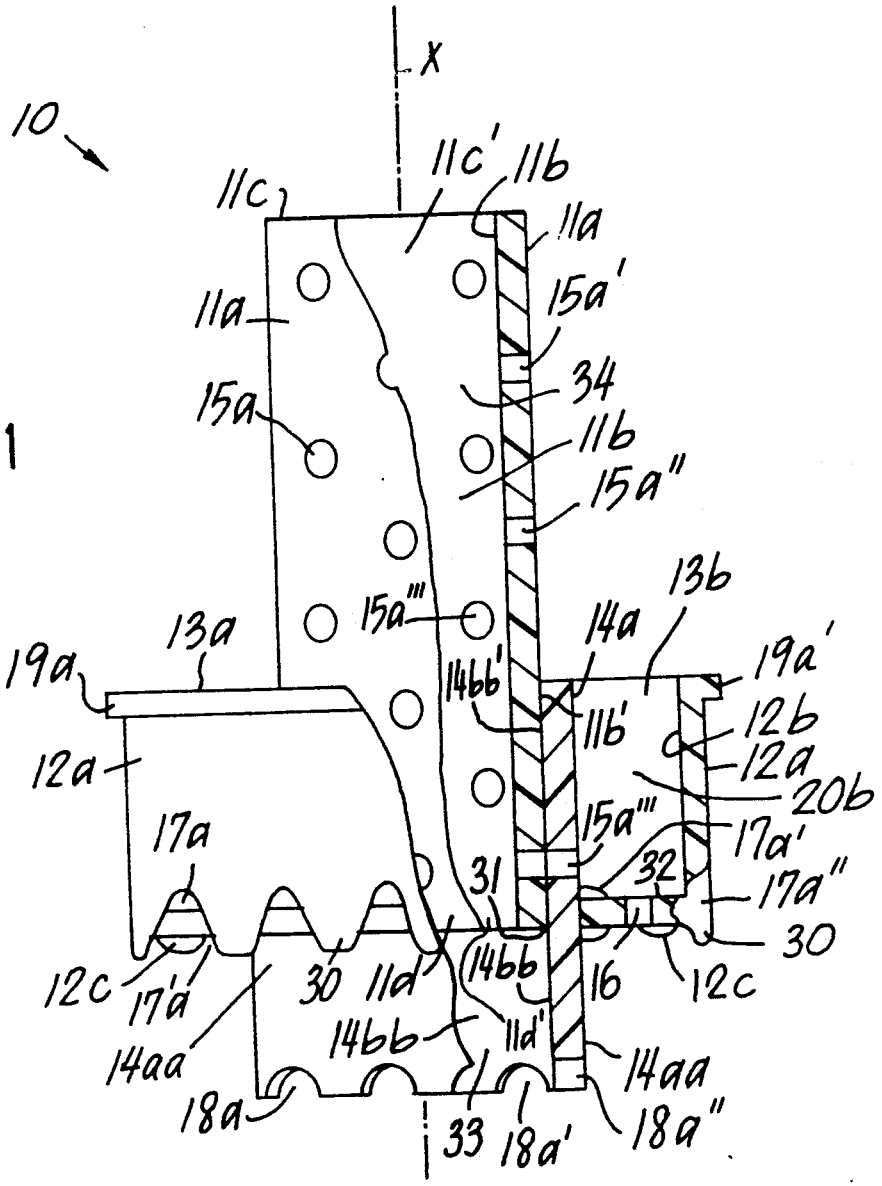
Figure 2:
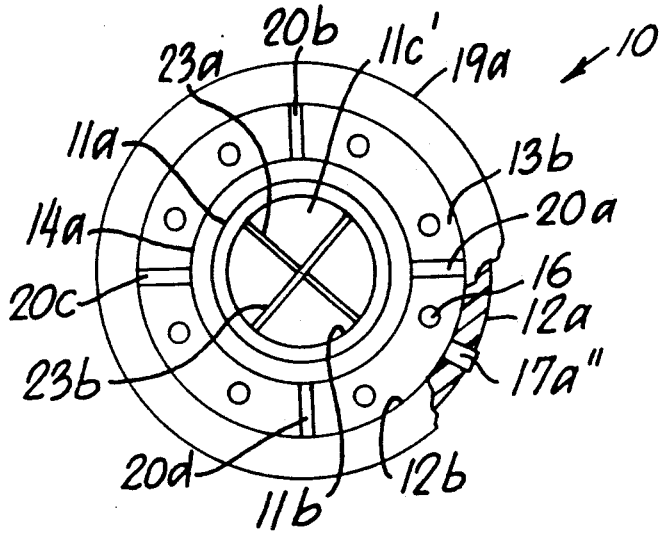
Figure 3:
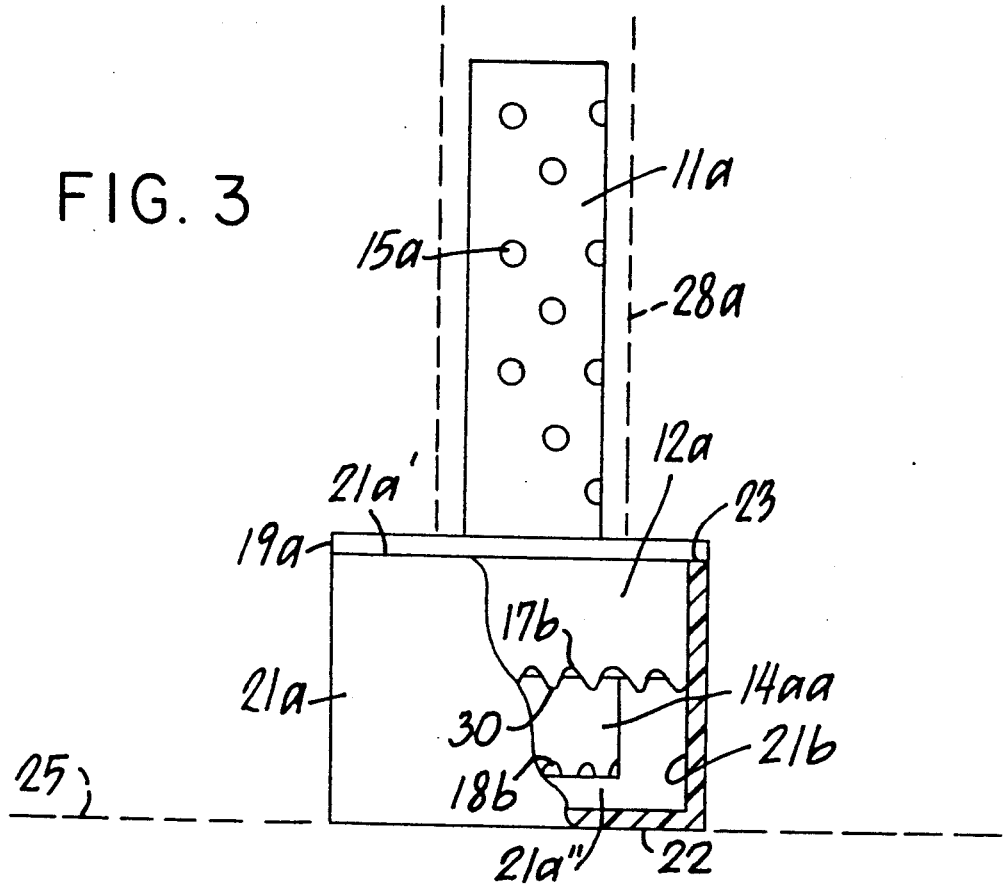
Figure 4:
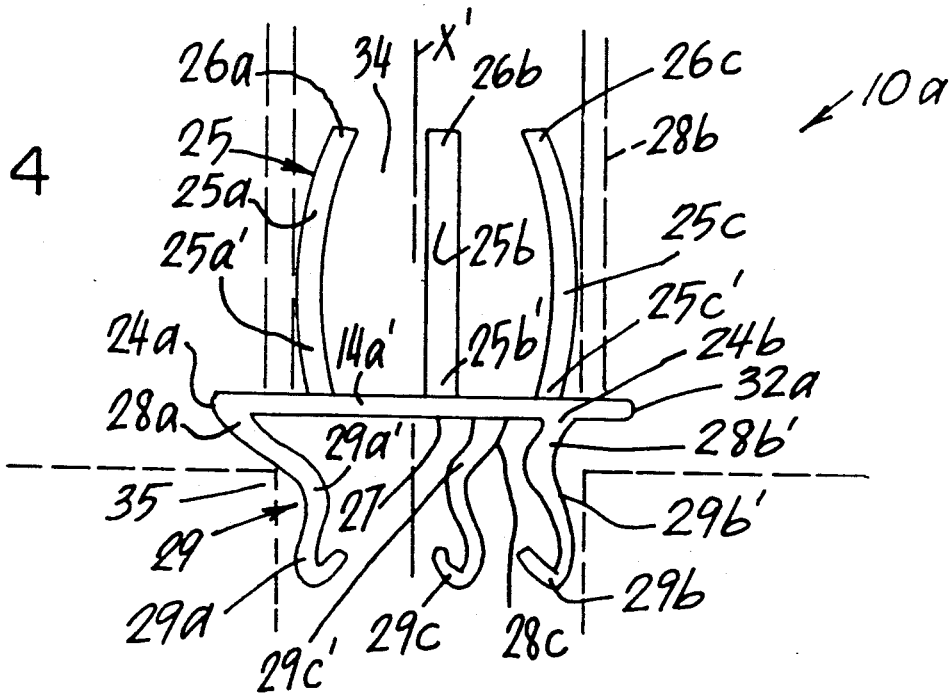
Figure 5:
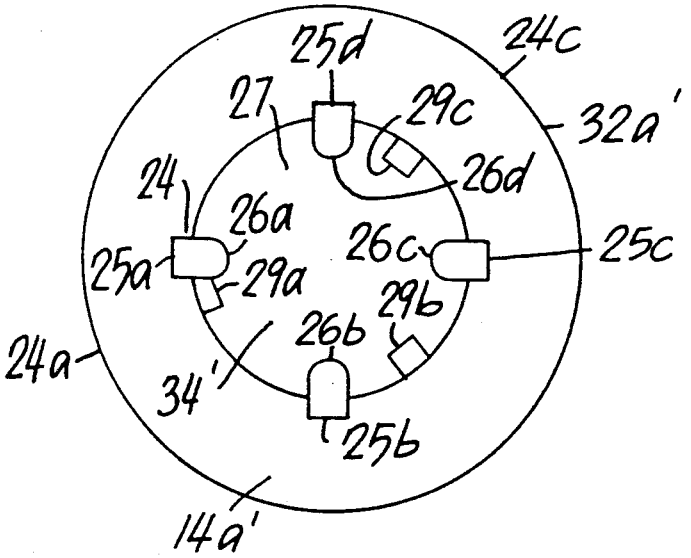
FIG. 5 illustrates a top view of the preferred embodiment of FIG. 4, better showing the arrangements of the respective elements described in FIG. 4.
Figure 6:
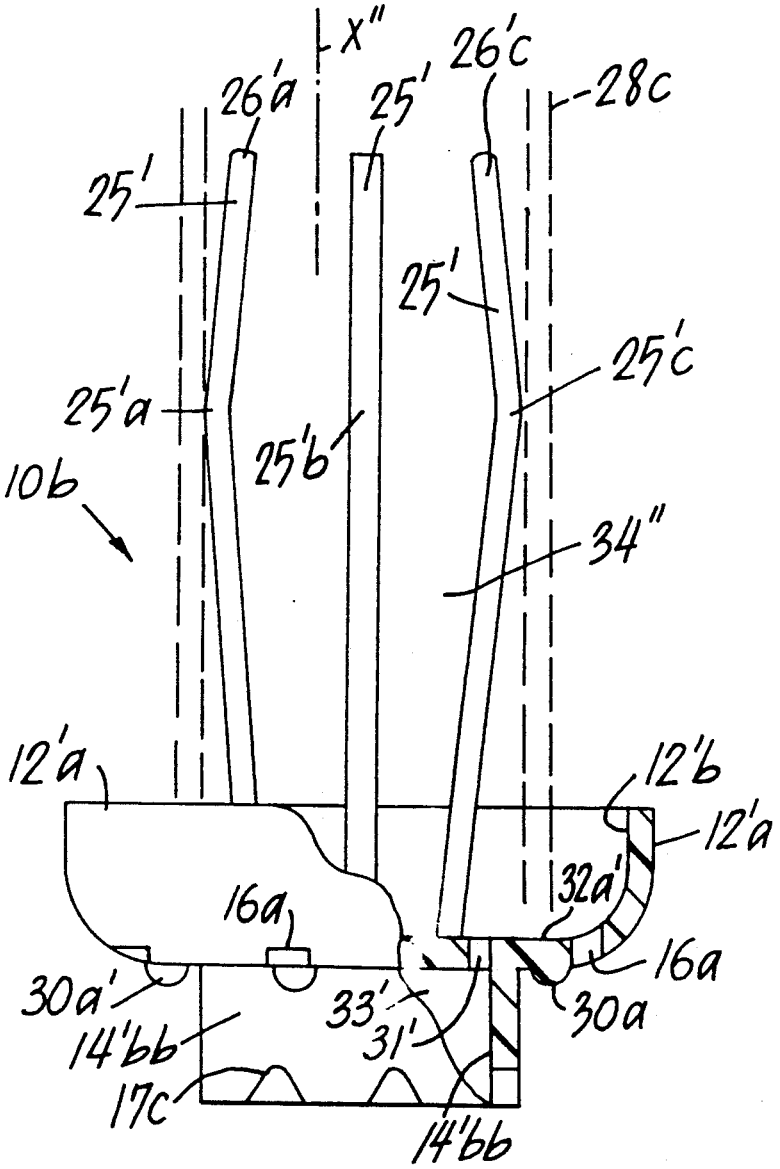
FIG. 6 illustrates in side view with partial cut-away, another preferred embodiment having basic similarities to the embodiment of FIG. 5, but having additional preferred features previously discussed for the preferred embodiment of FIGS. 1 and 2.
Figure 7:
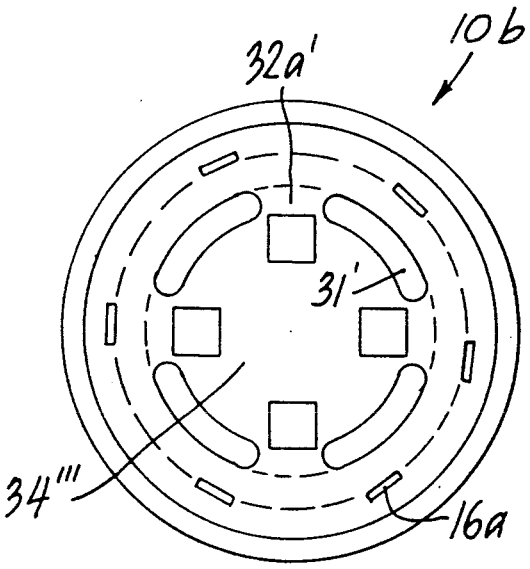
FIG. 7 illustrates in top view the preferred embodiment of FIG. 6, better showing the relationship of various elements thereof.
Figure 9:
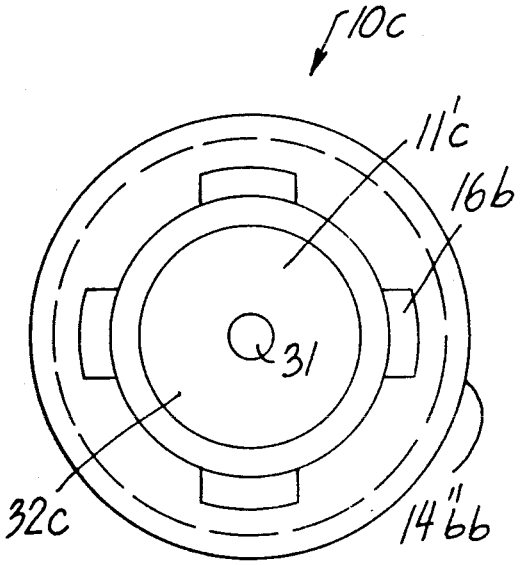
FIG. 9 illustrates a top view of the preferred embodiment of FIG. 8.
Figure 8:
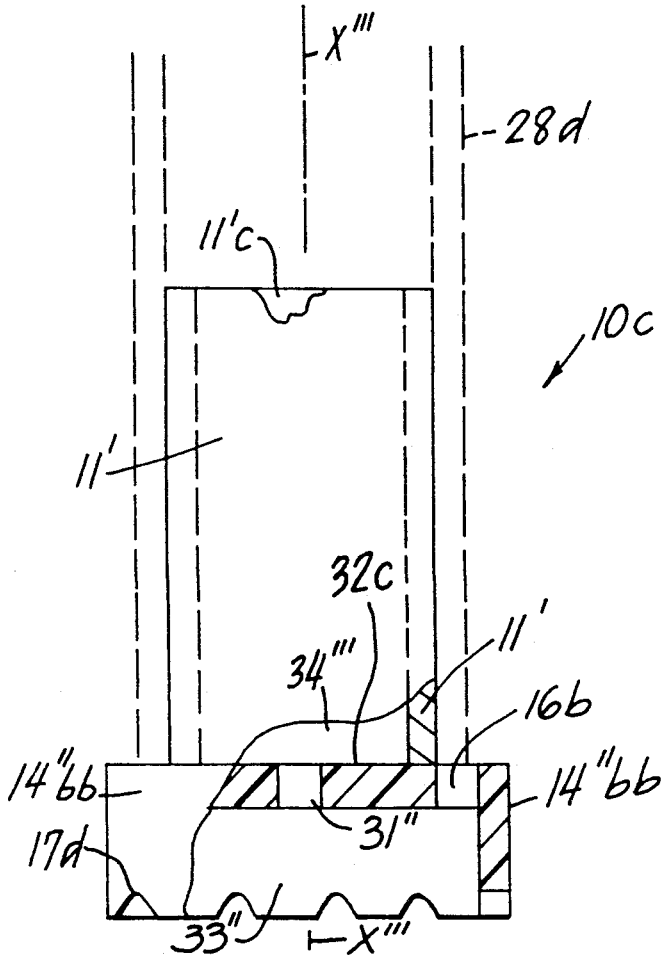
FIG. 8 illustrates in side view with partial cut-away, another preferred embodiment sharing various features and elements of other preferred embodiments discussed-above.

It is within the scope of the invention to make variations and/or changes and/or modifications and/or substitution of equivalents as would be obvious to a person of ordinary skill in this art.

I claim:

1. A sink drain paint roller holder for roller washing and draining, comprising in combination: an uprightly upwardly extending paint-roller support means having an upper end and a lower end and an imaginary longitudinal axis extending between the upper and lower ends with the paint-roller support means in an upright position, for uprightly supporting an end of a hollow paint roller having a roller length such that the roller length extends upwardly and downwardly along said longitudinal axis when the hollow paint roller is mounted on said upper end of the uprightly upwardly extending paint roller support means, said upper end having a predetermined cross-sectional area sufficiently small as to fit within space of a hollow paint roller, the upper end having radially outwardly-facing spaced-apart outer paint-roller support surfaces adapted for a hollow paint roller mountable around said upper end along said imaginary longitudinal axis when said upper end is inserted within a hollow paint roller, and a base means for mounting in a sink over and for draining therethrough into a sink drain, the base means having continuous upper and lower base structures forming continuous interior space in each of said upper and lower base structures and forming a first drain flow-path from exterior space through said interior space through said upper base structure and through said lower base structure to drain space below said lower base structure when the base means is seated over a sink drain, said base means including laterally-extending seating structure having a lower side structure adapted to seat on a substantially horizontal sink bottom of a sink having a sink drain, with the laterally-extending seating structure at said lower side structure forming a second drain flow-path drainable of liquid within sink space of said sink into the sink drain when said seating structure is seated on a sink bottom, the uprightly upwardly extending paint-roller support means at said lower end being uprightly mounted in said upright position on the base means, said uprightly upwardly extending paint-roller support means being positioned and structured such that drainage from the hollow paint roller is drainable through said first drain flow-path into a sink drain when the lower base structure is positioned in substantial alignment with the sink drain.

2. The sink drain paint roller holder of claim 1, in which said uprightly upwardly-extending paint-roller support means extends upwardly along said imaginary longitudinal axis and has spaced-apart outer paint-roller surfaces ranging radially outwardly around the imaginary support longitudinal axis to an outer diameter ranging up to about an inner diameter of the hollow paint roller mountable on the upwardly-extending paint-roller support means.

3. The sink drain paint roller holder of claim 2, in which said upwardly-extending paint-roller support means includes radially outwardly positioned inner surfaces being spaced-apart from one-another around said imaginary support longitudinal axis and forming an inner drain space therebetween in flow communication with said drain flow path, and in which said lower base structure has lower spaced-apart walls forming a lower portion of said first drain flow path therebetween and said upper base structure has first through-space forming-structure forming an upper portion of said first drain flow path.

4. The sink drain paint roller holder of claim 3, in which said uprightly upwardly extending paint-roller support means includes second through space-forming structure forming second through-space between said inner and outer surfaces and in flow communication with said first through-space.

5. The sink drain paint roller holder of claim 1, in which said upper base structure includes laterally extending structure having radially outwardly positioned support structure, and including downwardly-extending spaced-apart flange structure forming consecutively-occuring spaced-apart flanges separated by through-space gaps between the consecutively-occuring flanges, said downwardly-extending spaced-apart flanges being seatable on a sink bottom supporting the radially outwardly positioned support structure above the sink bottom such said gaps are in flow communication with the sink drain whereby flowable liquid in a sink is drainable into a drain within which the sink drain paint roller holder is mounted.

6. The sink drain of claim 2, in which said upwardly-extending paint-roller support means includes radially outwardly positioned inner surfaces being spaced-apart from one-another around said imaginary support longitudinal axis and forming an inner drain space therebetween in flow communication with said drain flow path, and in which said lower spaced-apart walls comprise separate downwardly-extending elongated members each having a lower proximal end mounted on said upper base structure and having a lower distal end directed downwardly.

7. The sink drain paint roller holder of claim 6, in which at-least one of said downwardly-extending elongated members is resilient such that said lower base structure resiliently engages and fits within any sink drain of any diameter.

8. The sink drain paint roller holder of claim 1, in which said downwardly-extending elongated members each are resilient such that said lower base structure resiliently engages and fits within any sink drain of any diameter.

9. The sink drain paint roller holder of claim 5, in which said lower base structure has lower spaced-apart walls forming said drain flow path therebetween, in which said lower spaced-apart walls comprise separate downwardly-extending elongated members each having a lower proximal end mounted on said upper base structure and having a lower distal end directed downwardly and having a lower intermediate portion, and in which said downwardly-extending elongated members each are resilient such that said lower base structure resiliently engages and fits within any sink drain of any diameter.

10. A sink drain paint roller holder for roller washing and draining, comprising in combination: an uprightly upwardly extending paint-roller support means having an upper end and a lower end and an imaginary longitudinal axis extending between the upper and lower ends with the paint-roller support means in an upright position, for uprightly supporting an end of a hollow paint roller having a roller length such that the roller length extends upwardly and downwardly along said longitudinal axis when the hollow paint roller is mounted on said upper end of the uprightly upwardly extending paint roller support means, said upper end having a predetermined cross-sectional area sufficiently small as to fit within space of hollow paint roller, the upper end having radially outwardly-facing spaced-apart outer paint-roller support surfaces adapted for a hollow paint roller to be mountable around said upper end along said imaginary longitudinal axis when said upper end is inserted within a hollow paint roller, and a base means for mounting in a sink over and for draining therethrough into a sink drain, the base means having continuous upper and lower base structures forming continuous interior space in each of said upper and lower base structures and forming a first drain flow-path from exterior space through said interior space through said upper base structure and through said lower base structure to drain space below said lower base structure when the base means is seated over a sink drain, said base means including laterally-extending seating structure having a lower side structure adapted to seat on a substantially horizontal sink bottom of a sink having a sink drain, with the laterally-extending seating structure at said lower side structure forming a second drain flow-path drainable of liquid within sink space of said sink into the sink drain when said seating structure is seated on a sink bottom, the uprightly upwardly extending paint-roller support means at said lower end being uprightly mounted in said upright position on the base means, said uprightly upwardly extending paint-roller support means being positioned and structured such that drainage from the hollow paint roller is drainable through said first drain flow-path into a sink drain when the lower base structure is positioned in substantial alignment with the sink drain, and in which said upper end has separate upwardly extending elongated members such that a hollow paint roller is mountable over said elongated members.

* * * * *